US005801487A

United States Patent [19]

Shinohara et al.

[11] Patent Number: 5,801,487

[45] Date of Patent: Sep. 1, 1998

[54] FLUORESCENT DISPLAY PANEL WITH PHOTO-SHIELD PLATE FOR DECREASING LIGHT REFLECTED ON FRIT

[75] Inventors: Toshiya Shinohara, Tokyo; Masaharu Satonaka, Kagoshima, both of Japan

[73] Assignee: NEC Corporation, Tokyo, Japan

[21] Appl. No.: 824,613

[22] Filed: Mar. 27, 1997

[30] Foreign Application Priority Data

Mar. 29, 1996 [JP] Japan ..... 8-075055

[51] Int. Cl.[6] ..... H01J 1/88

[52] U.S. Cl. ..... 313/495; 313/496; 313/497

[58] Field of Search ..... 313/495, 496, 313/497, 477 R

[56] References Cited

FOREIGN PATENT DOCUMENTS 6129056 2/1986 Japan .

62-98555 5/1987 Japan .

62-176953 11/1987 Japan .

63-18754 2/1988 Japan .

*Primary Examiner*—Sandra L. O'Shea

*Assistant Examiner*—Vip Patel

*Attorney, Agent, or Firm*—Sughrue, Mion, Zinn, Macpeak & Seas, PLLC

[57] ABSTRACT

A fluorescent display panel has a luminescent structure on an insulating substrate, a grid structure over the luminescent structure and filaments over the grid structure in an inner space defined by a case member bonded to the insulating substrate by means of frit, and the frit is pushed out from the boundaries between the case member and the insulating substrate; photo-shield plates are provided between the luminescent structure and the boundaries, and are arranged in such a manner as to be in parallel to the boundaries so as to block light component radiated from the luminescent structure to the boundaries.

5 Claims, 9 Drawing Sheets

FLUORESCENT DISPLAY PANEL WITH PHOTO-SHIELD PLATE FOR DECREASING LIGHT REFLECTED ON FRIT

FIELD OF THE INVENTION

This invention relates to a fluorescent display panel and, more particularly, to a fluorescent display panel effectively decreasing a light component reflected on pieces of frit used for bonding a cover member to a substrate.

DESCRIPTION OF THE RELATED ART

A typical example of the fluorescent display panel is illustrated in FIG. 1, and the prior art fluorescent display panel is of an internally bonded type. The prior art fluorescent display panel comprises a case structure 1. The case structure 1 includes an insulating substrate 1*a* of a rectangular configuration and a cover structure 1*b* of a channel configuration, and the cover structure 1*b* is bonded to the insulating substrate 1*a* by means of frit 1*c* of glass in such a manner as to define an inner space 1*d*. The frit 1*c* is glass having a low fusing point, and the frit 1*c* extending along the peripheral of the insulating substrate 1*a* is hatched so as to discriminate it from other components. The cover structure 1*b* has a top glass plate 1bb and spacer glass plates 1ba fixed to both longitudinal edges of the top glass plate 1bb, and the case structure 1 is airtight.

The prior art fluorescent display panel further comprises luminescent structures 2 mounted on the insulating substrate 1*a* at intervals, and the luminescent structure 2 is illustrated in FIG. 2 in detail. Each of the luminescent structure 2 includes wirings 2*a* formed on the insulating substrate 1*a*, an inter-level insulating layer 2*b* covering the wirings 2*a*, an anode 2*c* provided over the inter-level insulating layer 2*b* and a fluorescent layer 2*d* formed on the anode 2*c*. When thermion is brought into collision with the fluorescent layer 2*d*, light is emitted from the fluorescent layer 2*d*.

The prior art fluorescent display panel further comprises a plurality of grid structures 3 provided over the luminescent structures 2, respectively, and the grid structure 3 is illustrated in FIG. 3 in detail. The rightmost grid structure 3 is partially cut away in FIG. 1 so as to show the luminescent structure 2. The grid structure 3 includes a metallic mesh plate 3*a*, a pair of legs 3*b* fixed to both sides of the metallic mesh plate 3*a* and pieces 3*c* of conductive paste, and the legs 3*b* are fixed to the insulating substrate 1*a* by means of the pieces 3*c* of conductive paste.

The prior art fluorescent display panel further comprises a plurality of filaments 4*a* stretched over the grid structures 3, a pair of supporting members 4*b* fixed to the insulating substrate 1*a* and a plurality of lead members 5 projecting from the insulating substrate 1*a*. The plurality of filaments 4*a* are terminated at the pair of supporting members 4*b*, and the supporting members 4*b* are integral with the leftmost lead member 5*a* and the rightmost lead member 5*b*, respectively. The filaments 4*a* serves as a cathode. The other lead members 5 are selectively connected to the grid structures 3 and the anodes 2*c*, and the lead members 5 supply appropriate potentials to the filaments 4*a*, the grid structures 3 and the anodes 2*c*.

FIG. 4 illustrates another prior art fluorescent display panel of a frame type. Components of the other fluorescent display panel are labeled with references designating corresponding components of the prior art fluorescent display panel shown in FIGS. 1 to 3. The difference is the grid structures 3'. The grid structure 3' includes the metallic mesh plate 3*a* and a conductive frame 3*d* for supporting the metallic mesh plate 3*a* as shown in FIG. 6. The frame 3*d* is integral with the lead member 5 through an interconnecting portion 3*e*.

The prior art fluorescent display panels behave as follows. The anodes 2*c* and the grid structure 3 are positively biased with respect to the filament 4*a*. Thermion are radiated from the filaments 4*a*, and the grid structures 3 accelerate the thermions. The thermions pass through the metallic mesh plates 3*a*, and are brought into collision with the fluorescent layers 2*d*. Then, the fluorescent layers 2*d* emit light, and the light are observed through the cover structure 1.

Grains of fluorescent substance form the fluorescent layers 2*d*, and the surfaces of the grains are oriented at random. For this reason, the fluorescent layer 2*d* omnidirectionally radiates the light. A part of the light may be directed in the perpendicular direction to the metallic mesh plate 3*a*, and, accordingly, passes through the top glass plate 1bb.

Another part of the light proceeds in the longitudinal direction of the insulating substrate 1*a*, and is reflected on the supporting members 4*b*. The supporting members 4*b* are formed with the surfaces substantially perpendicular to the top glass plate 1bb and the surfaces substantially parallel to the top glass plate 1bb. Even if the reflection of light is incident on the top glass plate 1bb, the reflection of light is out of the visual field for the fluorescent layers 2*d*. Thus, the part of the light reflected on the supporting structures 4*b* hardly reaches an observer.

Yet another part of the light proceeds to the transverse direction of the insulating substrate 1*a*, and is reflected on the spacer glass plates 1ba and the frit 1*c*. The reflection of light from the spacer glass plates 1ba is hardly observed, because the spacer glass plates 1ba are perpendicular to the insulating substrate 1*a*. However, the frit 1*c* has surface ranging between 30 degrees to 60 degrees with respect to the spacer glass plates 1ba, and the reflectivity of the frit 1*c* is large. For this reason, the reflection of light from the frit 1*c* is liable to be incident on the top glass plate 1bb. Especially, if the prior art fluorescent display panels are designed to achieve a high luminance equal to or greater than 1400 cd/m$^2$, the reflection of light from the frit 1*c* is sensed by the observer. Thus, the prior art fluorescent display panels encounter a problem in the undesirable reflection from the frit 1*c*.

Various solutions have been proposed. One of the solutions is disclosed in Japanese Patent Publication of Unexamined Application No. 61-29056, and FIGS. 7 and 8 illustrate the structure of the fluorescent dot matrix display disclosed in the Japanese Patent Publication of Unexamined Application. A cover structure 5*a* is bonded to an insulating substrate 5*b* by means of frit 5*c*, and the cover structure 5*a* and the cover structure 5*a* defines an inner space. The spacer glass plate of the cover structure 5*a* is designated by reference 5*c*. Anodes 6*a* are provided on the insulating substrate 5*b*, and are covered with fluorescent layers 6*b*. Grid plates 7*a* are bonded to the insulating substrate 5*b* by means of frit 7*b*, and are perpendicular to not only the major surface of the insulating substrate 5*b* and, accordingly, the anodes 6*a* but also the spacer glass plates 5*c*. The height a of the grid plates 7*a* and the pitch b of the fluorescent layers 6*b* are suitably selected. Filaments 8 are stretched over the fluorescent layers 6*b*.

The grid plates 7*a* do not allow thermions to reach the fluorescent layers 6*b* thereunder, and prevents the fluorescent layers 6*b* from undesirable light emission due to the leakage thermions. The grid structure is effective against the light emission due to the leakage thermions in a highprecision fluorescent dot matrix display unit; however, the grid structure is less effective against the light component reflected on the frit 5c, because the grid plates 6b provide a narrow optical path extending in the transverse direction of the insulating substrate 5b to the light component.

Another solution is proposed in Japanese Patent Publication of Unexamined Application No. 62-98555, and similar solution is disclosed in Japanese Utility Model Publication of Unexamined-Application Nos. 62-176953 and 63-18754.

FIGS. 9 illustrates the vacuum case of the fluorescent display unit disclosed in Japanese Utility Model Publication of Unexamined Application No. 62-176953. The top and bottom surfaces are labeled with 6a and 6b, and 6c to 6f designate side surfaces of the vacuum case. The side surfaces 6c to 6f are usually bonded to the bottom surface 6b by means of frit (not shown). A visual image is formed on a part of the surface, and the other surfaces are covered with a photo-shield layer so as to decrease leakage light.

FIG. 10 illustrates the structure of the fluorescent display unit disclosed in Japanese Utility Model Publication of Unexamined Application No. 63-18754. A transparent insulating substrate 7a and a glass cover member 7b forms an inner space 7c, and filaments 7d and a grid member 7e are confined in the inner space 7c. Though not shown in FIGS. 10, the glass cover member 7b is usually bonded to the transparent insulating substrate 7a by means of frit. A wiring pattern 7f and anodes 7g are formed on the major surface of the transparent insulating substrate 7a, and the major surface is covered partially with a photo-shield insulating layer 7h and partially with a displaying pattern 7i. On the other hand, a photo-shield insulating layer 7j and a transparent conductive layer 7k are laminated on the glass cover member 7b. The photo-shield insulating layers 7h and 7j decrease leakage light.

However, the light component reflected from the frit obliquely passes through the transparent area for the visual image, and the leakage light component is non-ignoreable in a fluorescent display unit designed to achieve a high luminance. Moreover the photo-shield layer makes the fluorescent layers in the angle of field narrow.

SUMMARY OF THE INVENTION

It is therefore an important object of the present invention to provide a fluorescent display panel which decreases a light component reflected on a piece of frit without sacrifice of an angle of field for a fluorescent layer.

To accomplish the object, the present invention proposes to provide a photo-shield plate between grid members and an insulating substrate extending in parallel to a piece of frit.

In accordance with the present invention, there is provided a fluorescent display panel comprising: an insulating substrate having a major surface elongated in a first direction; a cover member bonded to said insulating substrate so as to form an inner space therebetween by means of frit, at least one layer of said frit extending along a boundary between said insulating substrate and said cover member in said first direction in said inner space; a cathode provided in said inner space for radiating electrons; a luminescent structure having an anode and a fluorescent layer provided on said major surface of said insulating substrate; a grid structure provided between said cathode and said luminescent structure; and at least one photo-shield member provided between said luminescent structure and said at least one layer of said frit, and having a photo-shielding surface opposed to said luminescent structure and directed substantially in parallel to said at least one layer of said frit so as to block a light component radiated in a second direction perpendicular to the first direction.

BRIEF DESCRIPTION OF THE DRAWINGS

The features and advantages of the fluorescent display panel according to the present invention will be more clearly understood from the following description taken in conjunction with the accompanying drawings in which.

DESCRIPTION OF THE PREFERRED EMBODIMENTS

First Embodiment

Figure 11:
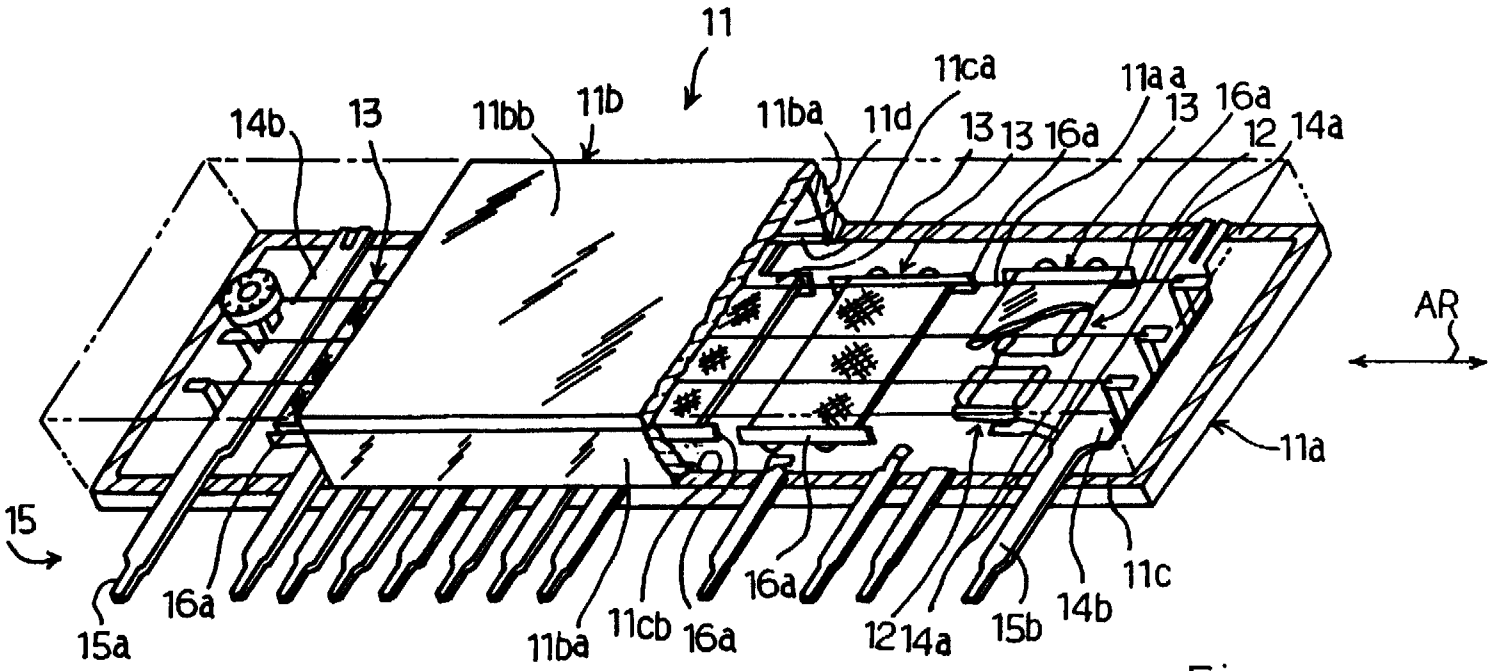
FIG. 11 is a partially cut-away perspective view showing a fluorescent display panel according to the present invention

Referring to FIG. 11 of the drawings, a fluorescent display panel embodying the present invention comprises an airtight case structure 11. The case structure 11 includes an insulating substrate 11a of a rectangular configuration and a cover structure 11b of a channel configuration, and the cover structure 11b is bonded to the insulating substrate 11a by means of frit 11c in such a manner as to define an inner space 11d. The insulating substrate 11a is elongated in a direction indicated by arrow AR, and has a major surface 11aa. A pair of spacer glass plates 11ba are bonded to a top glass plate 11bb, and form the cover structure 11b.

The frit 11c is glass having a low fusing point, and extends along the peripheral area of the insulating substrate 11a. The frit 11c is spread on the major surface 11aa and the lower surfaces of the spacer glass plates 11ba, and is hatched in FIG. 11 so as to easily discriminate it from other components. The frit 11c is spread on the peripheral area of the insulating substrate 11*a* about 1 millimeter thick, and the cover structure 11*b* is pressed against the frit 11*c*. A part of the frit 11*c* is pushed out from the boundary between the insulating substrate 11*a* and the cover structure 11*b*, and forms layers of frit 11ca and 11cb. The layers of frit 11ca/11cb extend in the longitudinal direction AR of the insulating substrate 11*a*.

Figure 1:
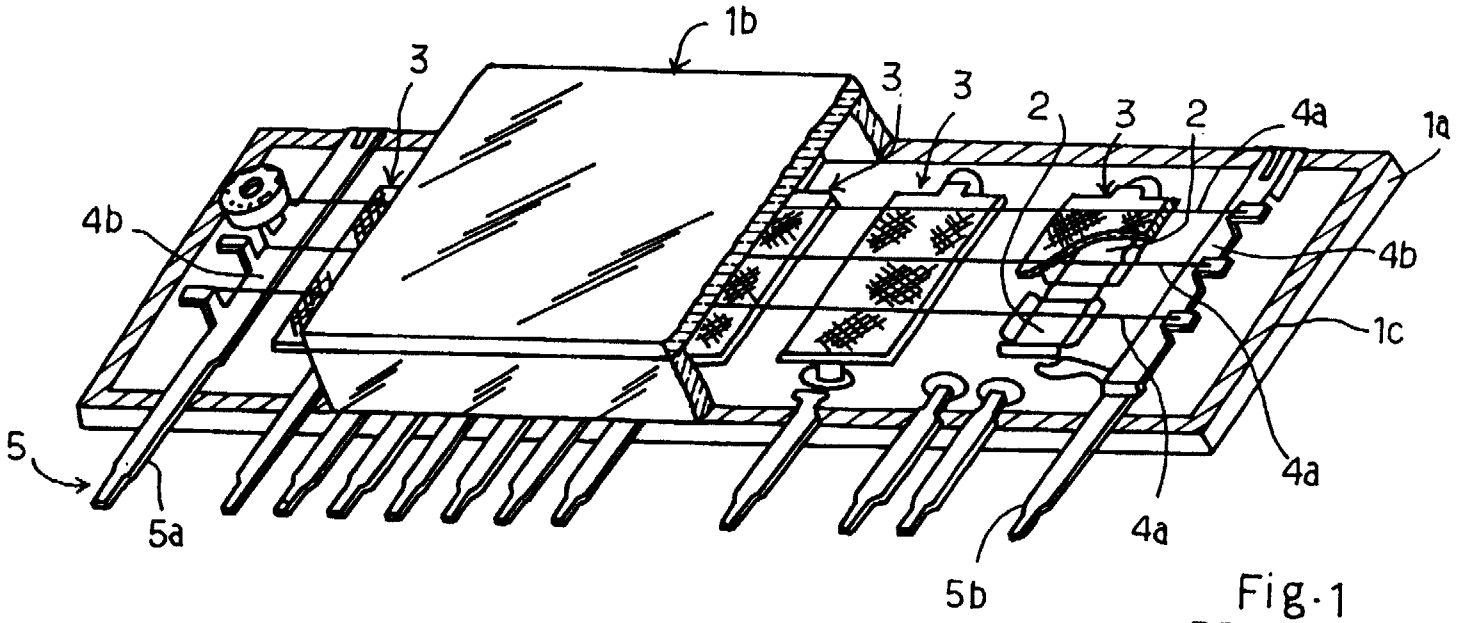
Fig. 1 PRIOR ART
FIG. 1 is a partially cut-away perspective view showing the structure of the prior art fluorescent display panel.
Figure 2:
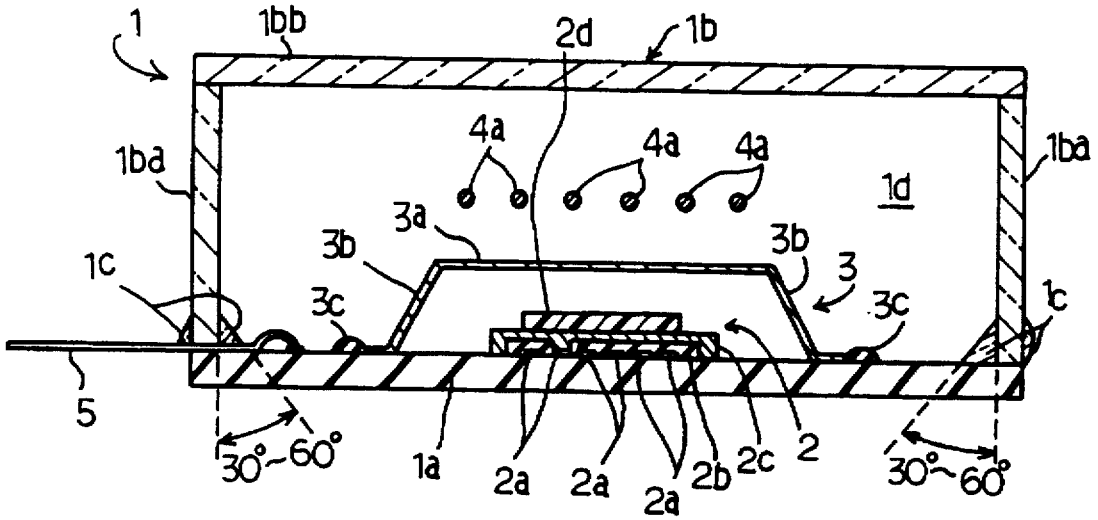
Fig. 2 PRIOR ART
FIG. 2 is a cross sectional view showing the structure of the prior art fluorescent display panel.
Figure 3:
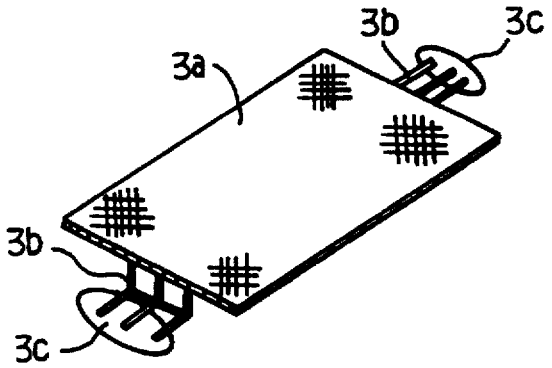
Fig. 3 PRIOR ART
FIG. 3 is a perspective view showing a grid member incorporated in the prior art fluorescent display panel.
Figure 4:
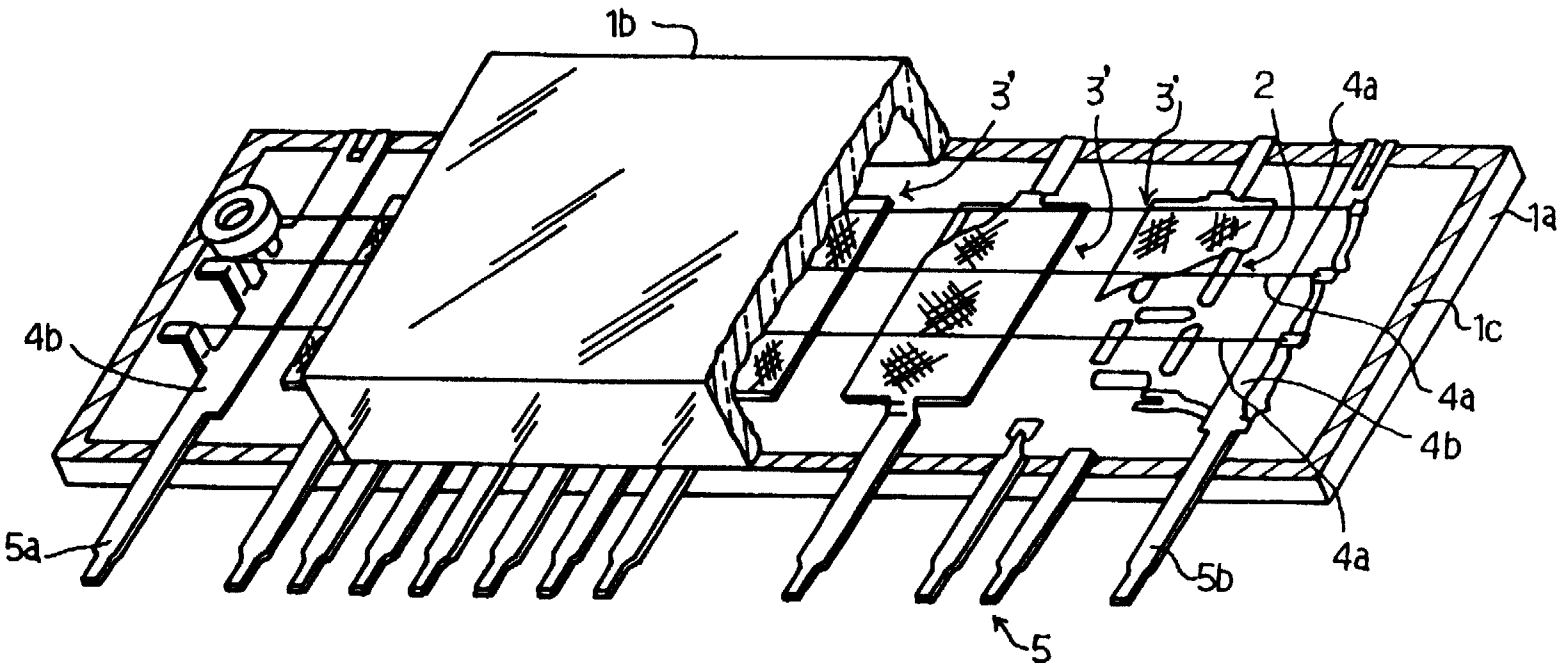
Fig. 4 PRIOR ART
FIG. 4 is a partially cut-away perspective view showing the structure of another prior art fluorescent display panel.
Figure 5:
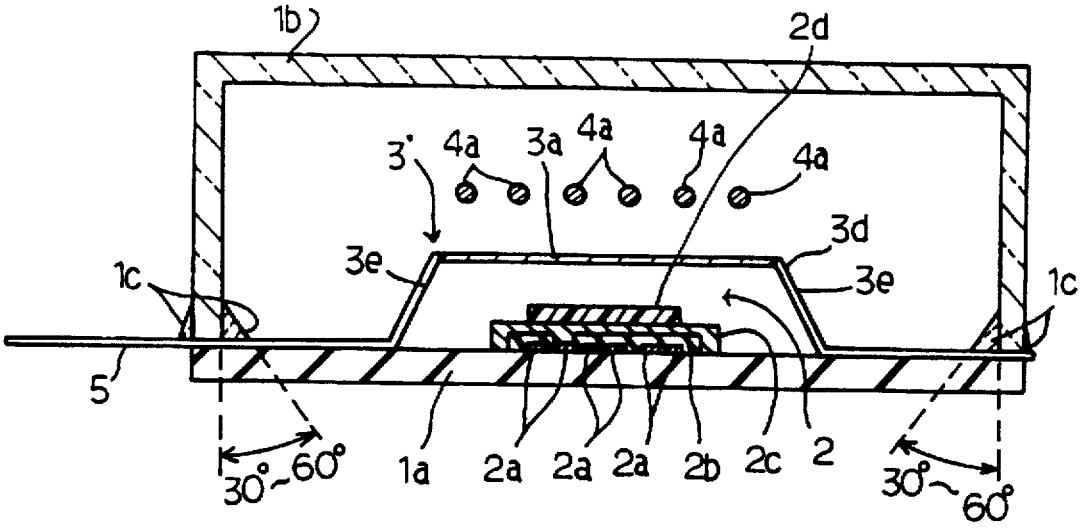
Fig. 5 PRIOR ART
FIG. 5 is a cross sectional view showing the structure of the prior art fluorescent display panel.
Figure 6:
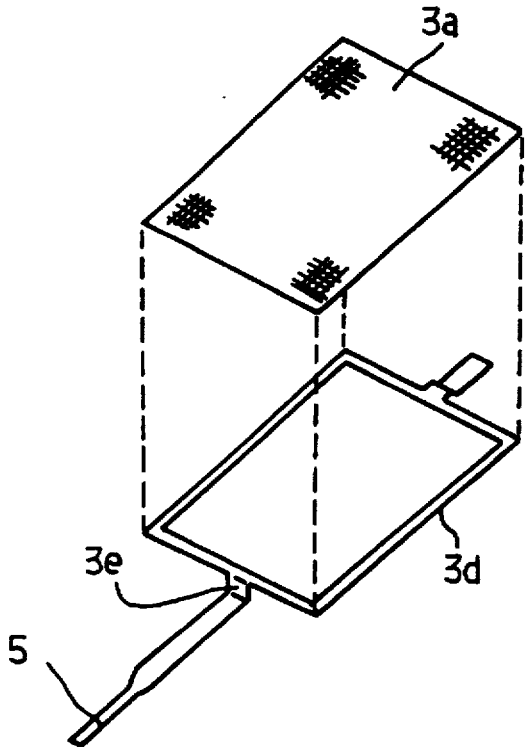
Fig. 6 PRIOR ART
FIG. 6 is a fragmentary perspective view showing a grid structure incorporated in the prior art fluorescent display panel.
Figure 7:
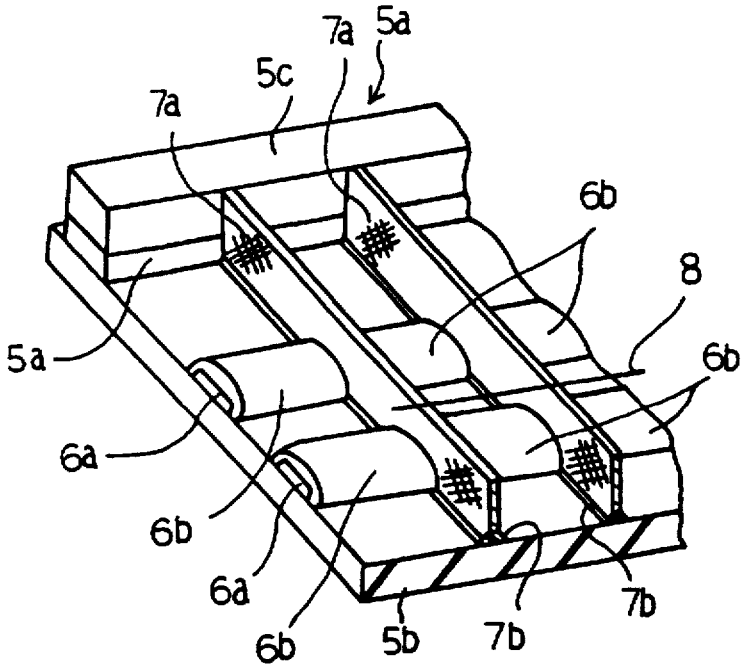
Fig·7 PRIOR ART
FIG. 7 is a perspective view showing the prior art fluorescent display unit disclosed in Japanese Patent Publication of Unexamined Application No. 61-29056.
Figure 8:
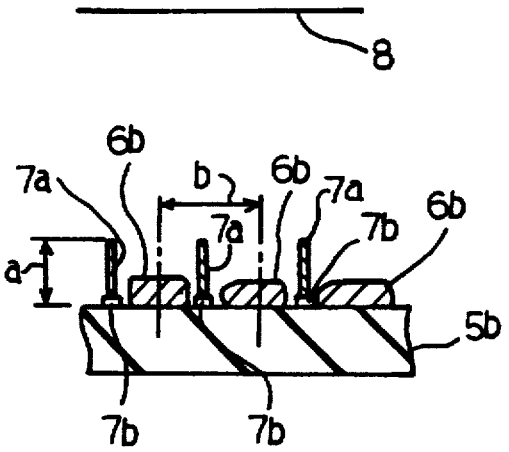
Fig·8 PRIOR ART
FIG. 8 is a cross sectional view showing the structure of the prior art fluorescent display unit shown in FIG. 7.
Figure 9:
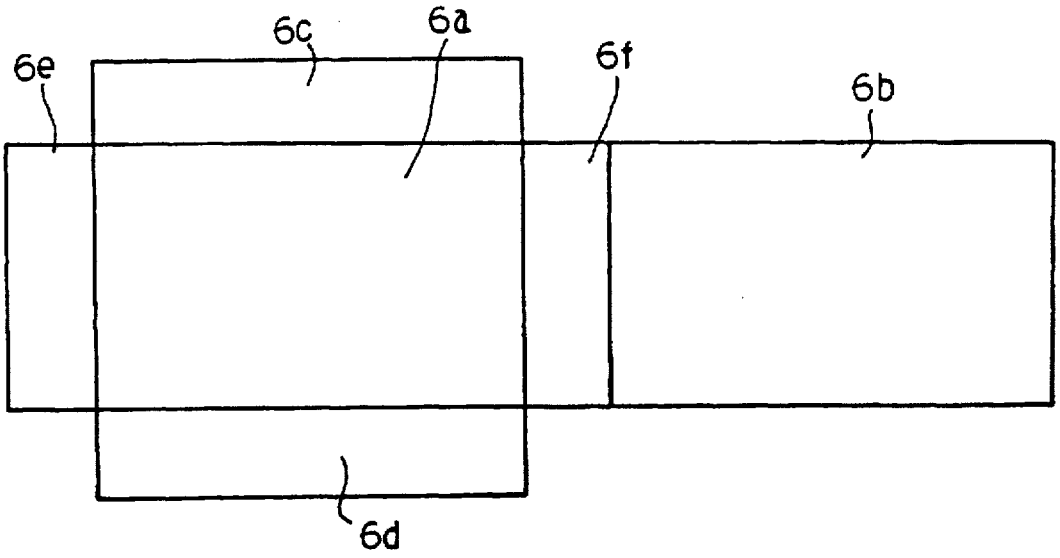
Fig·9 PRIOR ART
FIG. 9 is a development showing the vacuum case disclosed in Japanese Utility Model Publication of Unexamined Application No. 62-176953.
Figure 10:
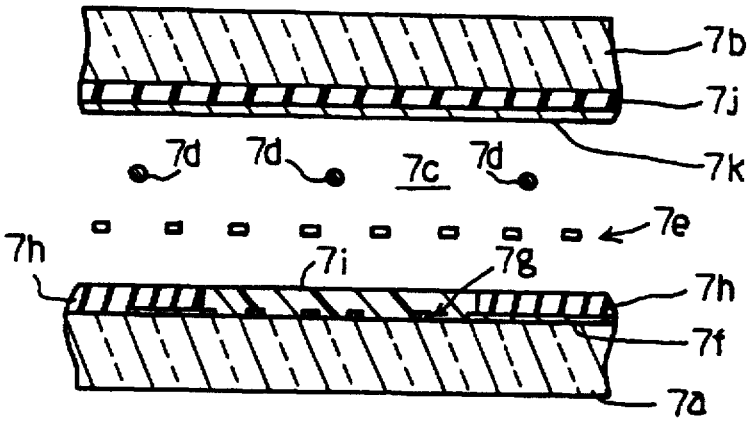
Fig·10 PRIOR ART
FIG. 10 is a cross sectional view showing the structure of the fluorescent display unit disclosed in Japanese Utility Model Publication of Unexamined Application No. 63-18754.

The fluorescent display panel further comprises a luminescent structures 12 mounted on the major surface 11aa of the insulating substrate 11*a* at intervals, and the luminescent structure 12 is similar in structure to the luminescent structure 2 of the prior art fluorescent display panel shown in FIG. 2. Namely, the luminescent structure 12 also includes wirings formed on the major surface 11aa of the insulating substrate 11*a*, an inter-level insulating layer covering the wirings, an anode provided over the inter-level insulating layer and a fluorescent layer formed on the anode.

Figure 12:
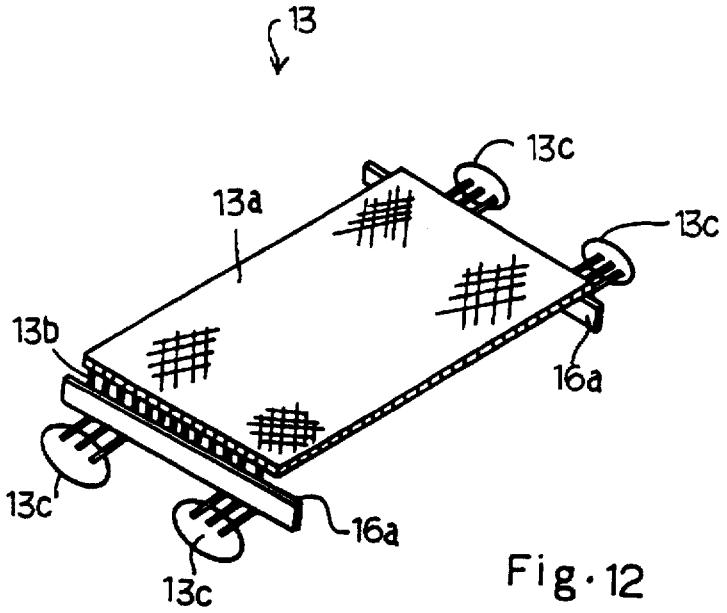
FIG. 12 is a perspective view showing photo-shield plates attached to a grid member.

The fluorescent display panel further comprises a plurality of grid structures 13 provided over the luminescent structures 12, respectively, and the grid structure 13 is illustrated in FIG. 12 in detail. The rightmost grid structure 13 is partially cut away in FIG. 11 so as to show the luminescent structure 12.

The grid structure 13 includes a metallic mesh plate 13*a*, a pair of legs 13*b* fixed to both sides of the metallic mesh plate 13*a* and pieces 13*c* of conductive paste. The legs 13*b* are bent so as to be in parallel to the major surface 11aa, and the pieces 13*c* of conductive paste fix the legs to the major surface 11aa. The leg 13*b* forms a kind of mesh screen, and takes up the thermal expansion during application of the potential to the grid structure 13.

The fluorescent display panel further comprises a plurality of filaments 14*a* stretched over the grid structures 13, a pair of supporting members 14*b* fixed to the insulating substrate 11*a* and a plurality of lead members 15 projecting from the insulating substrate 11*a*. The plurality of filaments 14*a* are terminated at the pair of supporting members 14*b*, and are welded thereto. The supporting members 14*b* are integral with the leftmost lead member 15*a* and the rightmost lead member 15*b*, respectively. The filaments 14*a* serves as a cathode. The other lead members 15 are selectively connected to the grid structures 13 and the anodes, and the lead members 15 supply appropriate potentials to the filaments 14*a*, the grid structures 13 and the anodes.

The fluorescent display panel further comprises a plurality of sets of photo-shield plates 16*a* attached to the pairs of legs 13*b* (see FIG. 12). The photo-shield plates 16*a* are provided between the luminescent structures 12 and the layers of frit 11ca/11cb, and are substantially parallel to the layers of frit 11ca/11cb. In other words, the photo-shield plates 16*a* are elongated in the direction AR. The length of the photo-shield plates 16*a* is longer than the width of the metallic mesh plates 13*a*, and is only spaced from the photo-shield plates 16*a* attached to the adjacent grid structures 13 by 0.1. millimeter. Moreover, the metallic mesh plate 13*a* is spaced from the major surface 11aa by 0.5 millimeter, and the photo-shield plate 16*a* is 0.4 millimeter in height. Thus, the photo-shield plates 16*a* occupy most of the virtual plane between the major surface 11aa and the metallic mesh plates 13*a*, and reduces the transmittance at more than 85 percent. As a result, the leakage light is practically ignoreable.

The fluorescent display panel is fabricated as follows. First, the wirings, the inter-level insulating layer, the anodes and the fluorescent layers are successively screen printed on the major surface 11aa of the insulating substrate 11*a*. Predetermined areas and the peripheral area on the major surface 11aa are covered with the pieces 13*c* of frit and the frit layer 11*c*, and the lower surfaces of the spacer glass plates 11ba are also coated with the frit.

A thin metal plate is selectively etched away so as to form the grid structure 13 and the photo-shield plates 16*a*. The legs 13*b* and the photo-shield plates 16*a* are bent, and the legs 13*b* are bonded to the major surface 11aa by means of the pieces of frit 13*c*.

The filaments 14*a* are welded to the supporting members 14*b*, and the lead members 15 and the supporting members 14*b* are assembled with the insulating substrate 11*a*.

The lower surfaces of the spacer glass plates 11ba are brought into contact with the peripheral area of the major surface 11aa, and the cover structure 11*b* is integrated with the insulating substrate 11*a*.

Finally, the air is evacuated from the inner space 11*d*.

As will be appreciated from the foregoing description, the shield plates 16*a* effectively reduces the leakage light, and do not make the angle of field narrow for the fluorescent layers. The photo-shield plates 16*a* and the grid structure 13 are concurrently formed through the etching, and the photo-shield plates 16*a* do not increase the production cost.

Second Embodiment

Figure 14:
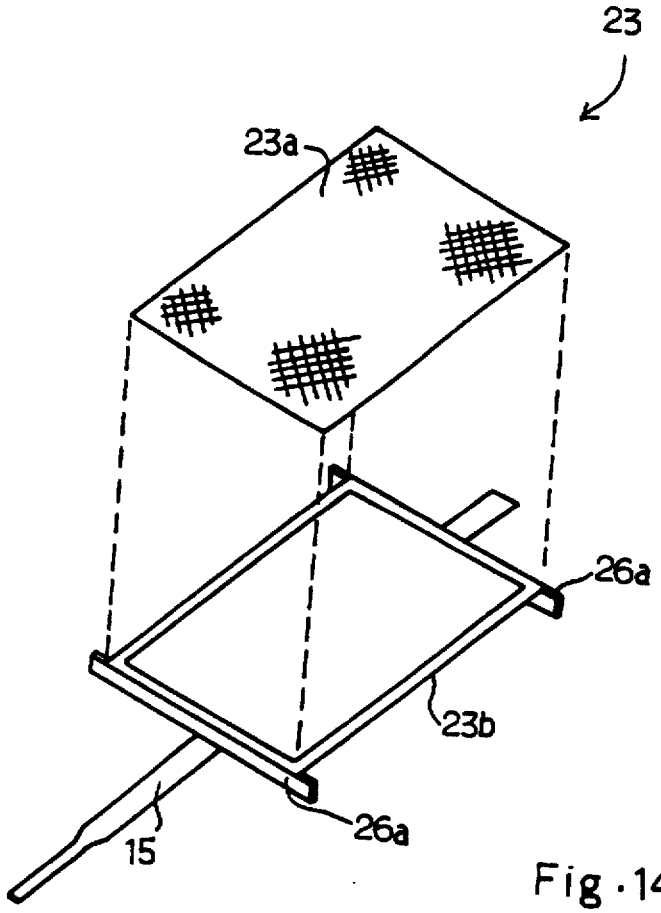
FIG. 14 is a fragmentary perspective view showing photo-shield plates attached to a frame of a grid structure.
Figure 13:
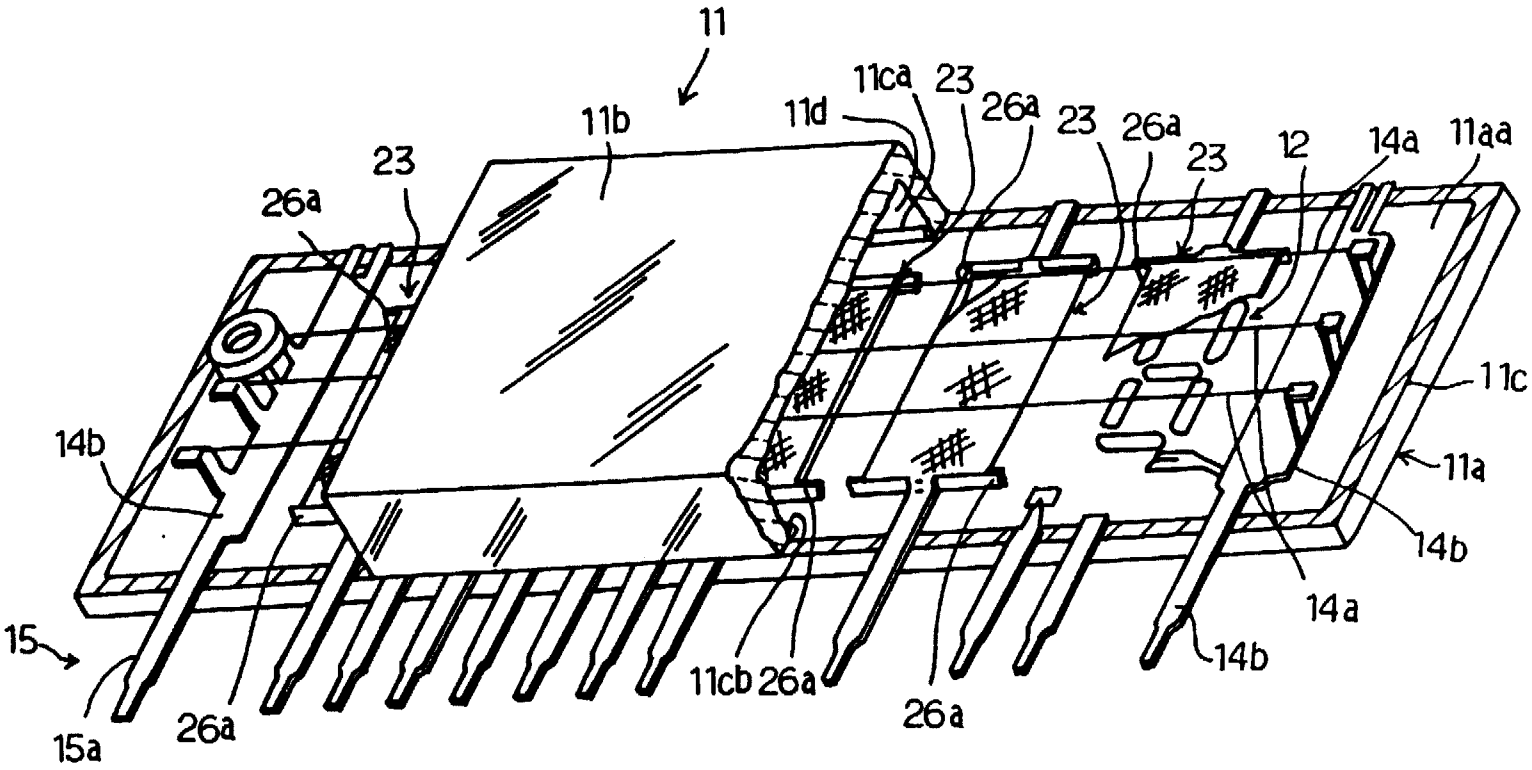
FIG. 13 is a partially cut-away perspective view showing another fluorescent display panel according to the present invention.

FIGS. 13 and 14 illustrate another fluorescent display panel of a frame type embodying the present invention. The fluorescent display panel implementing the second embodiment is similar to the first embodiment except for grid structure 23, and, for this reason, other components of the fluorescent display panel are labeled with references designating corresponding components of the fluorescent display panel shown in FIGS. 11 and 12.

The grid structure 23 includes a metallic mesh plate 23*a* and a conductive frame 23*b* for supporting the metallic mesh plate 23*a*, and the frame 23*b* is integral with the lead member 15. The conductive frame 23*b* is formed of a metallic plate of 0.2 millimeter thick, and the metallic mesh plate 23*a* is welded to the conductive frame 23*b*. The conductive frame 23*b* is bent so as to space the metallic mesh plate 23*a* from the major surface 11aa by 0.5 millimeter. Photo-shield plates 26*a* are welded to the conductive frames 23*d*, and are in parallel to the layers of frit 11ca/11cb between the luminescent structures 12 and the layers of frit 11ca/11cb.

The fluorescent display panel implementing the second embodiment reduces the leakage light without sacrifice the angle of field for the fluorescent layers.

Although particular embodiments of the present invention have been shown and described, it will be obvious to those skilled in the art that various changes and modifications may be made without departing from the spirit and scope of the present invention.

For example, the photo-shield plates 16*a*/26*a* may be directly attached to the major surface of the insulating substrate in so far as the photo-shield plates are in parallel to the layers of frit between the luminescent structures and the layers of frit.

What is claimed is:

1. A fluorescent display panel comprising:

an insulating substrate having a major surface elongated in a first direction;

a cover member bonded to said insulating substrate so as to form an inner space therebetween by means of frit, at least one layer of said frit extending along a boundary between said insulating substrate and said cover member in said first direction in said inner space;

a cathode provided in said inner space for radiating electrons;

a luminescent structure having an anode and a fluorescent layer provided on said major surface of said insulating substrate;

a grid structure provided between said cathode and said luminescent structure; and at least one photo-shield member provided between said luminescent structure and said at least one layer of said frit, and having a photo-shielding surface opposed to said luminescent structure and directed substantially in parallel to said at least one layer of said frit so as to block a light component radiated in a second direction perpendicular to said first direction.

2. The fluorescent display panel as set forth in claim 1, in which said at least one photo-shield member is integral with said grid structure.

3. The fluorescent display panel as set forth in claim 2, in which said grid structure has a mesh plate provided over said luminescent structure, legs integral with said mesh plate and said photo-shield member and attached to said major surface.

4. The fluorescent display panel as set forth in claim 1, in which said cover member is bonded to both sides of said insulating substrate extending in said first direction so that not only said at least one layer of said frit but also another layer of said frit are formed along said both sides in said inner space, and said at least one photo-shield member further has another photo-shielding surface opposed to said luminescent structure and directed substantially in parallel to said another layer of said frit.

5. The fluorescent display panel as set forth in claim 1, in which said grid structure has a mesh plate and a frame sub-structure integral with a conductive lead and attached to said major surface for supporting said mesh plate over said luminescent structure, and said photo-shield member is fixed to said frame sub-structure.

* * * * *